United States Patent [19]

Tanaka et al.

[11] Patent Number: 5,010,799

[45] Date of Patent: Apr. 30, 1991

[54] ELECTRONIC KEYBOARD INSTRUMENT WITH KEY DISPLACEMENT SENSORS

[75] Inventors: Kikuji Tanaka; Kohtaro Hanzawa, both of Fussa, Japan

[73] Assignee: Casio Computer Co., Ltd., Tokyo, Japan

[21] Appl. No.: 496,128

[22] Filed: Mar. 19, 1990

Related U.S. Application Data

[63] Continuation of Ser. No. 278,603, Dec. 1, 1988, abandoned.

[30] Foreign Application Priority Data

Dec. 1, 1987 [JP] Japan ..... 62-305969

[51] Int. Cl.[5] ..... G10H 1/057; G10H 1/46

[52] U.S. Cl. ..... 84/627; 84/629; 84/633

[58] Field of Search ..... 84/626-633, 84/658, 615, 662-665, 687-690, 701-711, DIG. 7

[56] References Cited

U.S. PATENT DOCUMENTS 4,178,823 12/1979 McCoskey et al. ..... 84/1.01

4,651,611 3/1987 Deforeit ..... 84/1.1

*Primary Examiner*—Stanley J. Witkowski

*Attorney, Agent, or Firm*—Frishauf, Holtz, Goodman & Woodward

[57] ABSTRACT

An electronic keyboard instrument has a plurality of key displacement sensors disposed in relation to respective keys of a keyboard. Each sensor detects a continuously variable key displacement induced by the key operation to provide an analog signal indicative of the displacement. An analog-to-digital converter digitizes the analog signal at a predetermined sampling rate to derive a stream of digital samples of key displacement. A control, which operates based on a predetermined tone control algorithm receives and analyzes the stream of digital samples. According to the analysis, tone parameters such as envelope and vibrato are produced for controlling the characteristics of a tone, so that a tone having a very dynamic key touch response is developed. In a preferred embodiment, there are provided a plurality of tone control algorithms adapted to process the stream of key displacement samples in manners different from one another. A manually operative selector selects the desired one of the algorithms to be used by the control during the play of the instrument.

12 Claims, 8 Drawing Sheets

ELECTRONIC KEYBOARD INSTRUMENT WITH KEY DISPLACEMENT SENSORS'

This application is a continuation of application Ser. No. 07/278,603, filed Dec. 1, 1988 and now abandoned.

BACKGROUND OF THE INVENTION

This invention generally relates to electronic musical instruments and particularly to an electronic keyboard instrument having a function of touch response for controlling a tone based on the detected touch of the key.

The prior art electronic keyboard instrument has used a key state sensor in the form of one or more contact switches disposed in relation to each key of the keyboard. These contact switches are arranged so as to change their states at two different positions of the key. When the key is depressed, the key will pass by a first predetermined displacement, changing the switch to another state, and then pass by a second predetermined displacement, causing further change of the switch state. An initial touch measuring apparatus connected to the contact switch measures the time for the key to move from the first displacement to the second. The measured time is, of course, in inverse proportion to the depressing velocity of the key. This information is utilized to control a tone, thus providing a touch response.

It is noted, however, that the time of moving between predetermined key displacements, as extracted by the prior art, is the sole variable factor that varies depending on the key operation. This indicates that the touch response provided by the prior art is insufficient and leaves room for improvement.

SUMMARY OF THE INVENTION

Therefore, an object of the present invention is to provide an electronic keyboard instrument capable of extracting the characteristics of the key operation in a unique manner.

Another object of the invention is to provide an electronic keyboard instrument capable of providing more dynamic tone control depending on the key operation.

In accordance with the present invention, there is provided an electronic keyboard instrument which comprises keyboard means having a plurality of keys, a plurality of key displacement sensor means each disposed in relation to each key for detecting variable displacement of the key induced by the key operation, and tone control means for processing the detected displacement signal from the key displacement sensor means to produce tone parameters on the basis of the processing.

The key displacement sensor means in the present keyboard instrument is in sharp contrast to the contact switch in the prior art, as stated in the background of the invention in that the former provides an output indicative of continuously variable key displacement whereas the latter merely senses the key passing by predetermined discrete positions.

Each key displacement sensor means preferably comprises a sensor for providing an analog signal of the key displacement and analog-to-digital (A/D) converter means for digitizing the analog signal at a predetermined sampling rate to provide digital samples of key displacement.

The tone control means may include initial peak detection means for detecting when the displacement has reached its first peak during the key operation and note-on means responsive to the initial peak detection means for producing a note-on signal indicative of the start of a tone. The tone control means may further comprise envelope control means for controlling envelope parameters defining the amplitude of the tone on the basis of the processing of the displacement signal. The tone control means may further comprise vibrato control means for controlling vibrato parameters on the basis of the processing of the displacement signal.

The tone parameters such as envelope and vibrato parameters may be either a function of the magnitude of the current displacement sample provided by A/D converter means or a function of the difference between the magnitudes of any two successive displacement samples. Some parameters (e.g., envelope parameters) may be generated when the key is moving up whereas other parameters (e.g., vibrato parameters) may be developed when the key is moving down. The direction of the key movement is ascertained by direction determining means that makes a comparison between any two successive digital samples of key displacement.

In accordance with a further aspect of the invention, there is provided an electronic keyboard instrument which comprises keyboard means having a plurality of keys, a plurality of key displacement sensor means each disposed in relation to each key for detecting variable displacement of the key induced by the key operation, a plurality of selectively operable tone control means for processing the detected displacement signal from the key displacement sensor means in a different manner from one another to provide tone parameters and selector means for selecting one of the plurality of tone control means as being operative during the play of the instrument.

With this arrangement, the user can select the desired tone control means having the intended touch response.

BRIEF DESCRIPTION OF THE DRAWINGS

The above and other objects, features and advantage of the invention will be apparent from the following description in connection with the accompanying drawing in which.

DETAILED DESCRIPTION OF A PREFERRED EMBODIMENT

Figure 1:
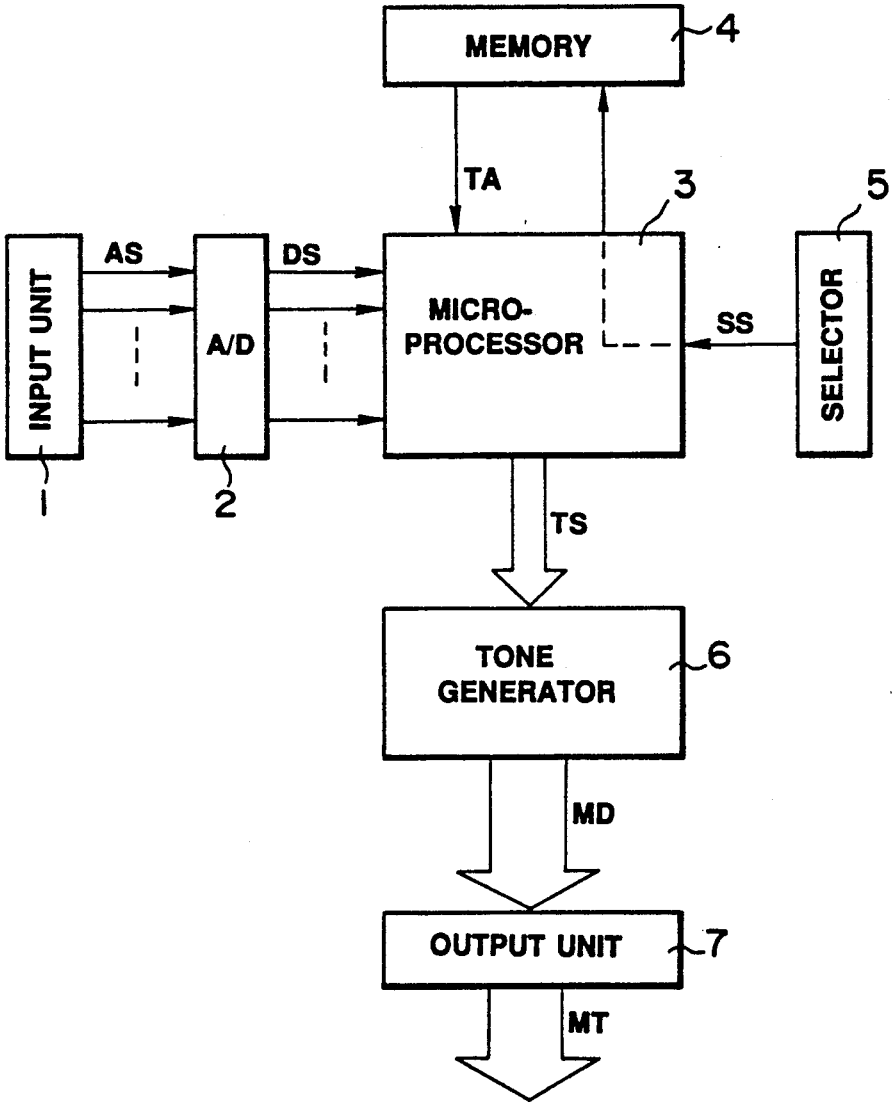
FIG. 1 is an overall arrangement of an electronic keyboard instrument incorporating features of the invention.

FIG. 1 shows an overall arrangement of an electronic keyboard instrument embodying the present invention. The keyboard instrument comprises key displacement sensor means including an input device 1 which senses a continuously variable displacement of a key induced by the key operation. An A/D converter 2 digitizes the analog key displacement signal AS detected by the input device 1 at a predetermined sampling rate to provide digital samples DS of key displacement which are then successively supplied to a microprocessor 3 for tone control. The instrument further comprises a memory 4 which stores a plurality of tone control algorithms adapted to process the digital samples of key displacement in a different manner from one another to derive tone parameters TS having different touch responses, and a manually operable selector 5 which selects the desired tone control algorithm in the memory 4 to be used during the play of the instrument. Thus, the microprocessor 3 runs the selected tone control algorithm specified by the select signal SS from the selector 5 to produce and supply tone parameters TS to a tone generator 6. Correspondingly, the tone generator 6 produces a tone signal MD which is then fed to an output unit 7 comprising amplifiers and loudspeakers from which a musical tone MT is sounded.

Figure 2:
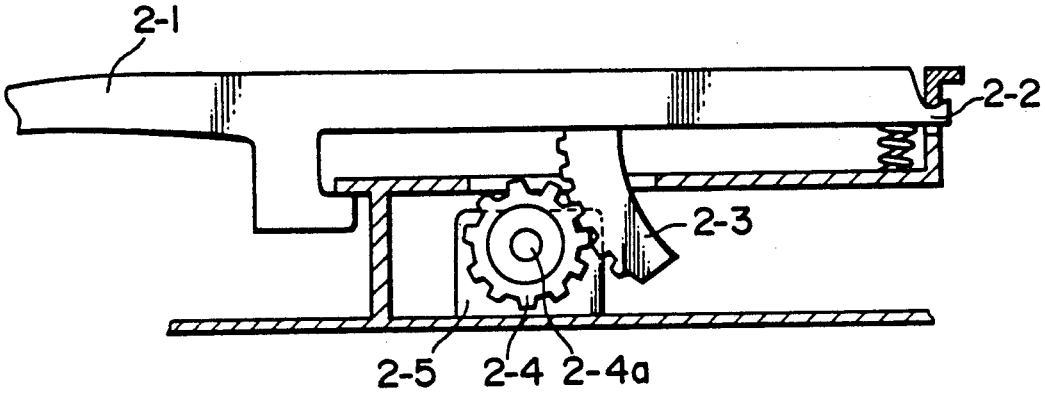
FIG. 2 is a view of a key structure including a key displacement sensor.
Figure 3:
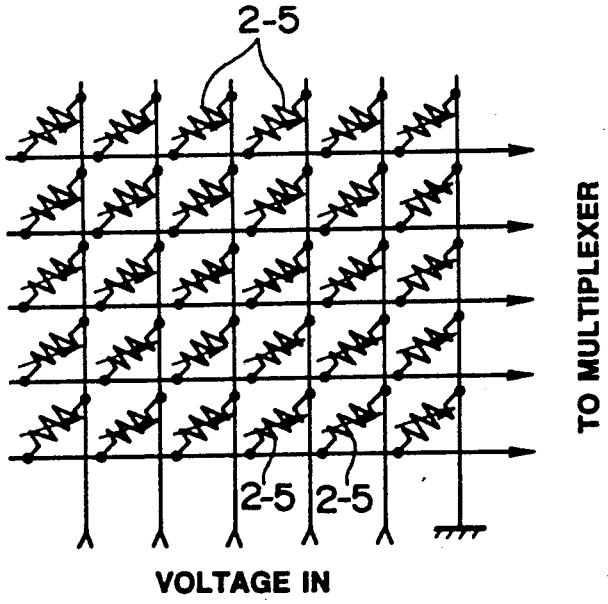
FIG. 3 is a diagram of a circuit associated with the key displacement sensors.
Figure 4A:
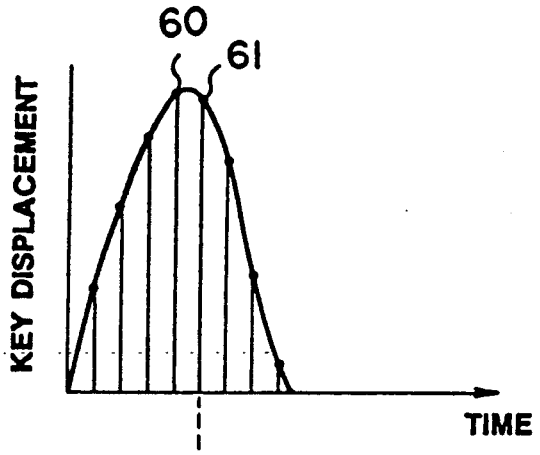
FIGS. 4(*a*)–4(*3*) are timecharts of input and output signals for a wind instrument sound.
Figure 4B:
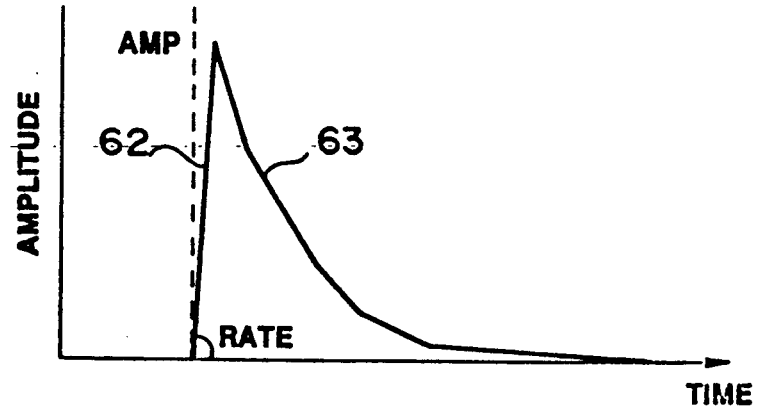
Figure 4C:
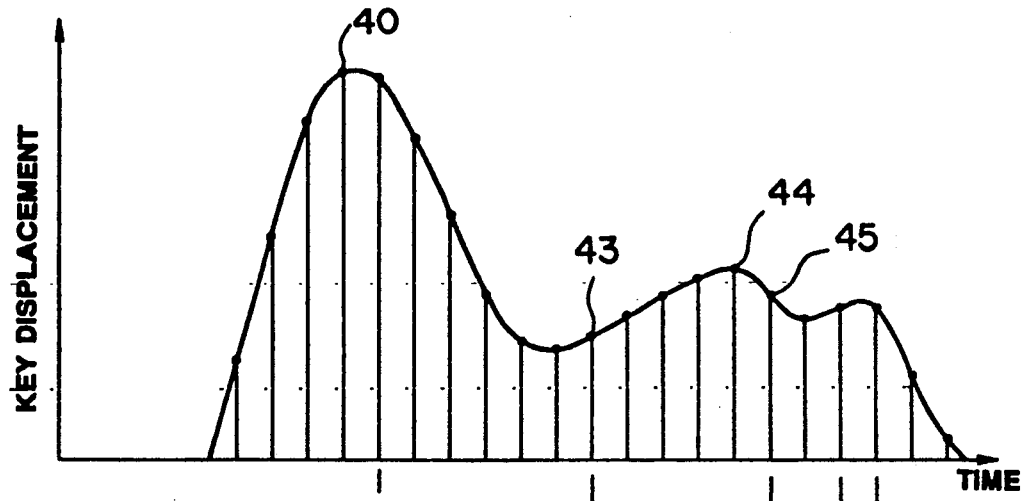
Figure 4D:
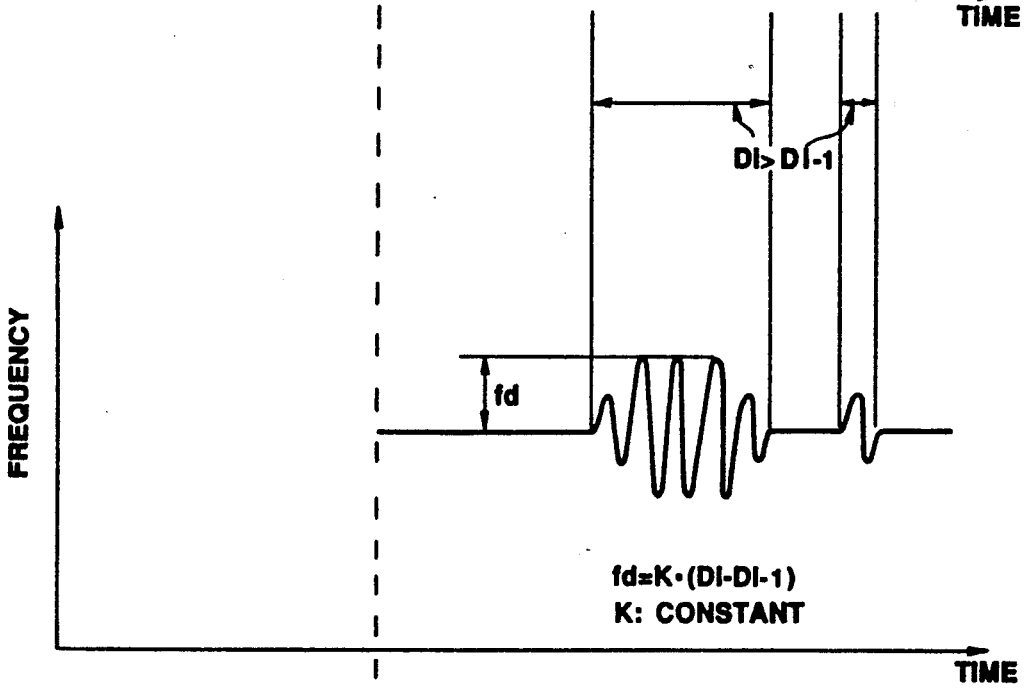
Figure 4E:
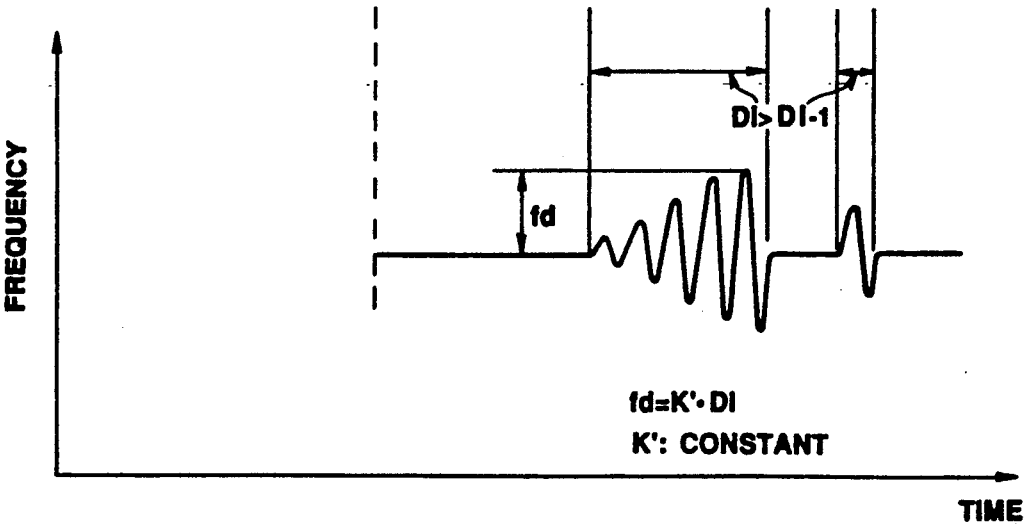

The input device 1 which is a featuring element of the instrument comprises a plurality of key displacement sensors disposed in relation to respective keys of the keyboard. FIG. 2 shows the structure of each key of the keyboard. When the illustrated key 2-1 is depressed, it will move around a pivot 2-2. The continuously changing key displacement is converted to an angular displacement by means of a rack 2-3 mounted on the key 2-1 and a pinion 2-4 in engagement with the rack 2-3. Thus, the pinion 2-4 and a variable resistor 2-5 (key displacement sensor) mounted on the axle of the pinion 2-4 rotate so that the resistance of the variable resistor 2-5 will indicate the key displacement. Turning to FIG. 3, the key displacement sensor 2-5 for all the keys 2-1 are connected to form a matrix in a circuit. When scanned, a voltage is successively applied to the columns of the matrix circuit and the resultant analog voltage outputs each indicative of key displacement appear on the rows of the matrix circuit. These analog voltages are supplied to the A/D converter 2 via a multiplexer (not shown) so that the microprocessor 3 will acquire key displacement data for each key of the keyboard.

After a tone control algorithm for a wind instrument sound has been selected by the selector 5, that algorithm is executed by the microprocessor 3. The details of the tone control will now be described in conjunction with FIGS. 4(*a*)–4(*e*) and 5.

Figure 5:
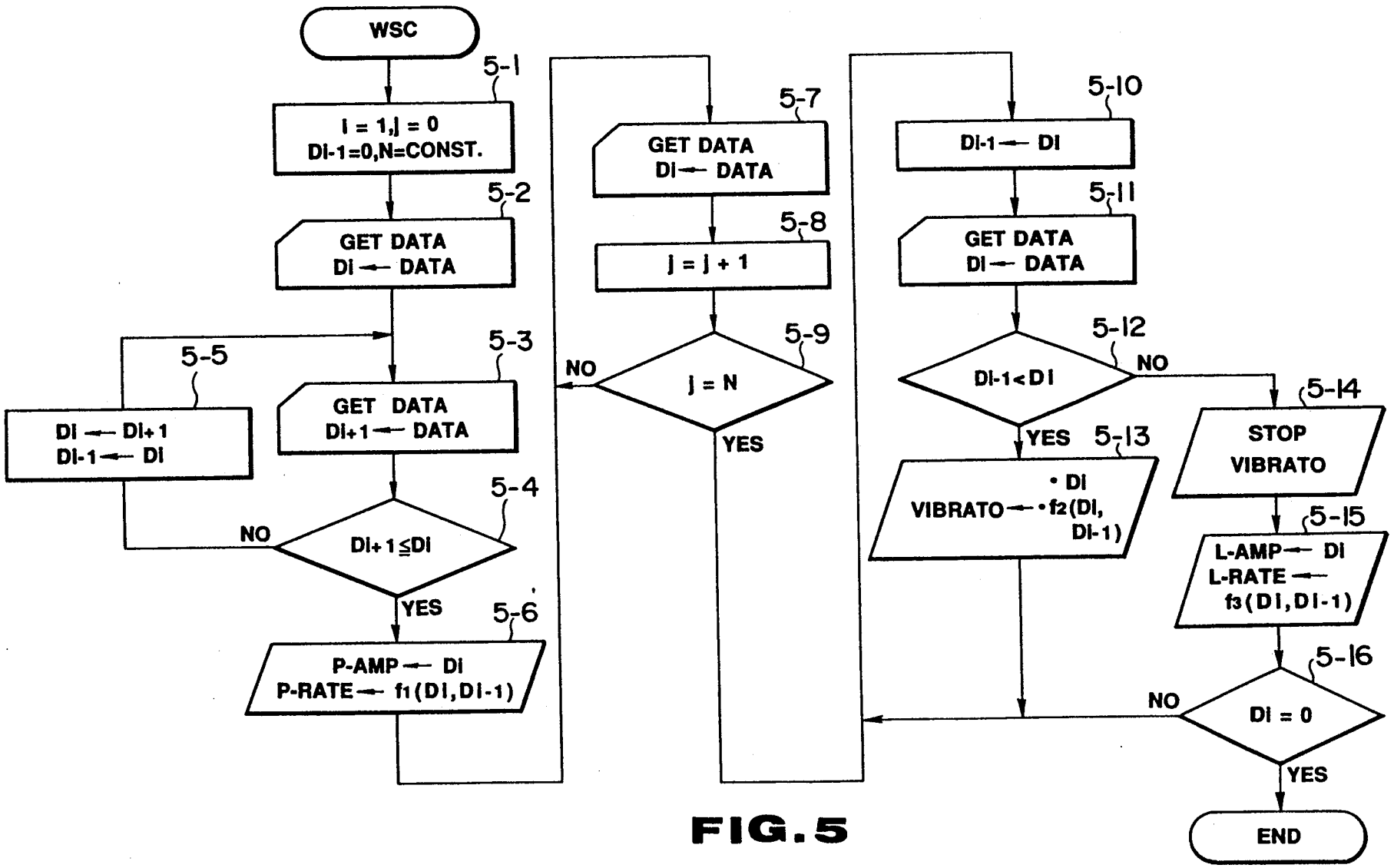
FIG. 5 is a flowchart of a tone control algorithm for the wind instrument sound.

FIGS. 4(*a*)–4(*e*) show a time profile of the key displacement signal (FIGS. 4(*a*) and 4(*c*)) and the characteristics of a tone generated from the key displacement signal in accordance with the wind instrument sound algorithm. More specifically, part in FIG. 4(*b*) depicts the time characteristic of the amplitude of the generated tone whereas parts and FIG. 4(*d*) and (*e*) each indicates the time characteristic of the frequency of the generated tone. FIG. 5 shows the flow of the operation of the microprocessor 3 in accordance with the wind instrument sound control algorithm.

In the early stage of the key operation, the microprocessor 3 monitors when the key displacement will reach its first peak (see steps 5-1 to 5-5 in FIG. 5). In accordance with the wind instrument sound control algorithm, the first peak is defined by the digital sample of key displacement that satisfies the following conditions:

(a) all digital samples preceding that digital sample increase with time, thus indicating the downward movement of the key for the first time; and (b) that digital sample is no less than the next sample, meaning the upward movement of the key.

The key displacement profile shown in FIG. 4(*a*) has its initial peak indicated by digital sample 40. Upon detection of the first peak, the microprocessor 3 provides a note-on signal including attack envelope parameters to the tone generator 6 to start the sounding of a tone (step 5-6 in FIG. 5). These attack envelope parameters consist of an attack level P-AMP and an attack rate P-RATE. The attack level P-AMP is given the value of the first detected peak of key displacement whereas the attack rate P-RATE is given as a function of the digital sample of the first peak and the immediately preceding one, such as P-RATE$=KX(D_i-D_{i-1})$ wherein $D_i$ is the sample of the first peak, $D_{i-1}$ is the immediately preceding sample and K is constant. Using the attack rate P-RATE and level P-AMP, the tone generator 6 forms the attack segment of the tone envelope,, as indicated by a ramp 50 in FIG. 4(*b*).

After the detection of the first peak of the key displacement, the microprocessor 3 waits until a predetermined length of time will elapse in order to sustain the amplitude of the tone during that period. The sustain segment of the tone envelope so formed is indicated by a horizontal line 51 in part FIG.

Thereafter, each time the microprocessor 3 reads a new sample of key displacement, it compares the new sample with the old (immediately preceding) one to determine whether the key is moving up or down (see steps 5-10 to 5-12 in FIG. 5). When having found that the key is moving upwards, as observed at points 41, 42, 45 in part (a) of FIG. 4A, the microprocessor 3 provides envelope parameters consisting of level and rate of decay L-AMP, L-RATE to the tone generator 6 (see step 5-15 in FIG. 5). As a result, a decay segment of the tone envelope is formed, as exemplified by a slope 52 in FIG. 4(*b*).

On the other hand, if it is found from the comparison between the two successive digital samples of key displacement that the key is being lowered, the microprocessor 3 provides a vibrato parameter to the tone generator 6 (see step 5-12 in FIG. 5), thus causing the tone to vary in pitch periodically. It is noted from FIG. 4(*a*) that the key moves in an upward direction again between points 43 and 44 after passing its first peak 40. The parameter of vibrato depth may be computed using either the current sample of key displacement or both of the current and previous samples. For example, the vibrato depth fd is given by the difference between the two successive digital samples $(D_i-D_{i-1})$ multiplied by a constant K. In this case, the tone frequency varies as shown in FIG. 4(*d*). When the vibrato depth fd is given by $K'D_i$, the tone frequency modulates as indicated in FIG. 4(*e*).

The vibrato will stop when the key turns again in an upward direction, as illustrated at point 45 in FIG. 4(*a*) (steps 5-12 and 5-14).

The completion of the key operation is determined by the return of the digital sample to zero indicative of the rest position of the key (step 5-16).

Once the selector has selected a tone control algorithm for a percussive sound, this algorithm is run by the microprocessor 3. The details of the percussive sound control will be described hereinbelow in conjunction with FIGS. 6(*a*), 6(*b*) and 7.

Figure 6:
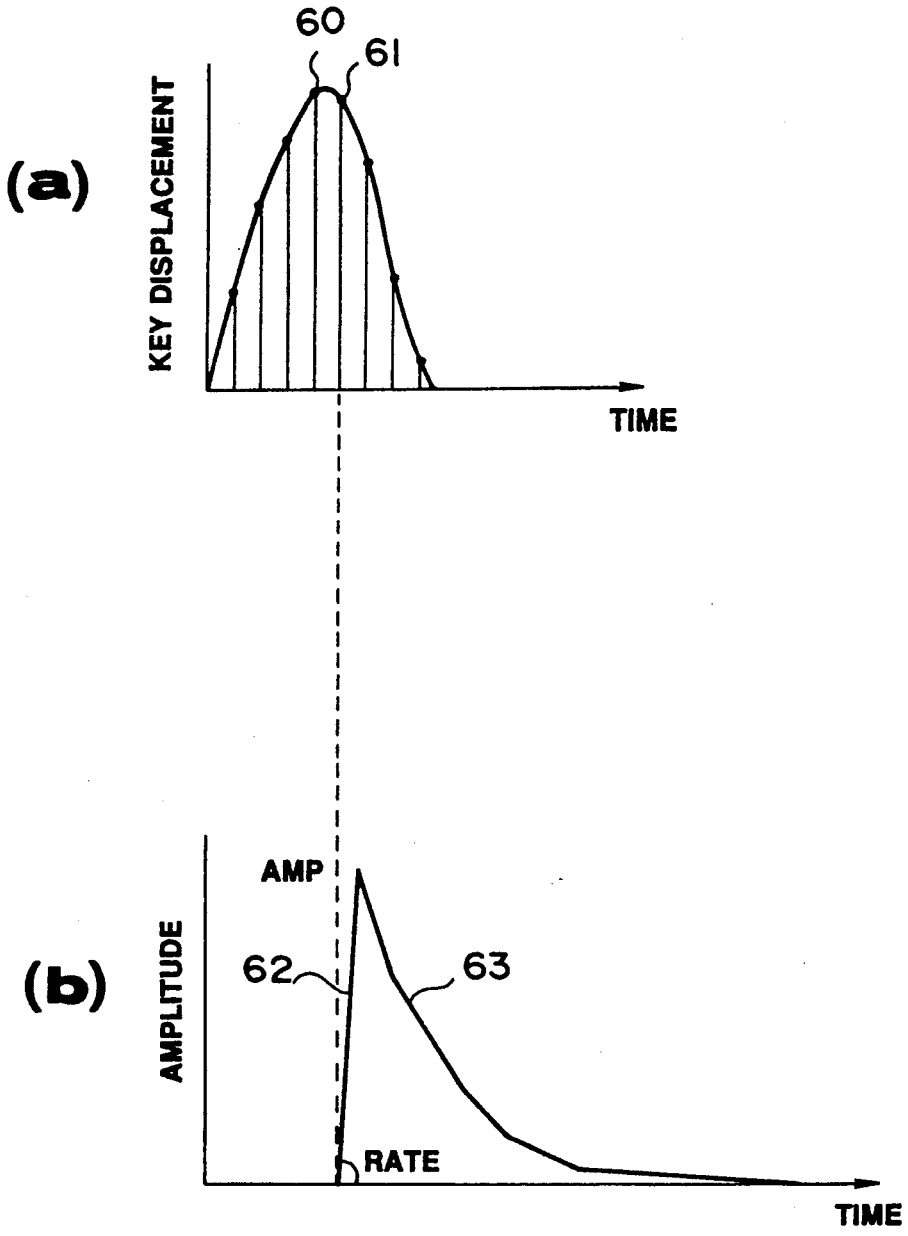
FIGS. 6(*a*) and 6(*b*) are time charts of input and output signals for a percussive sound.
Figure 7:
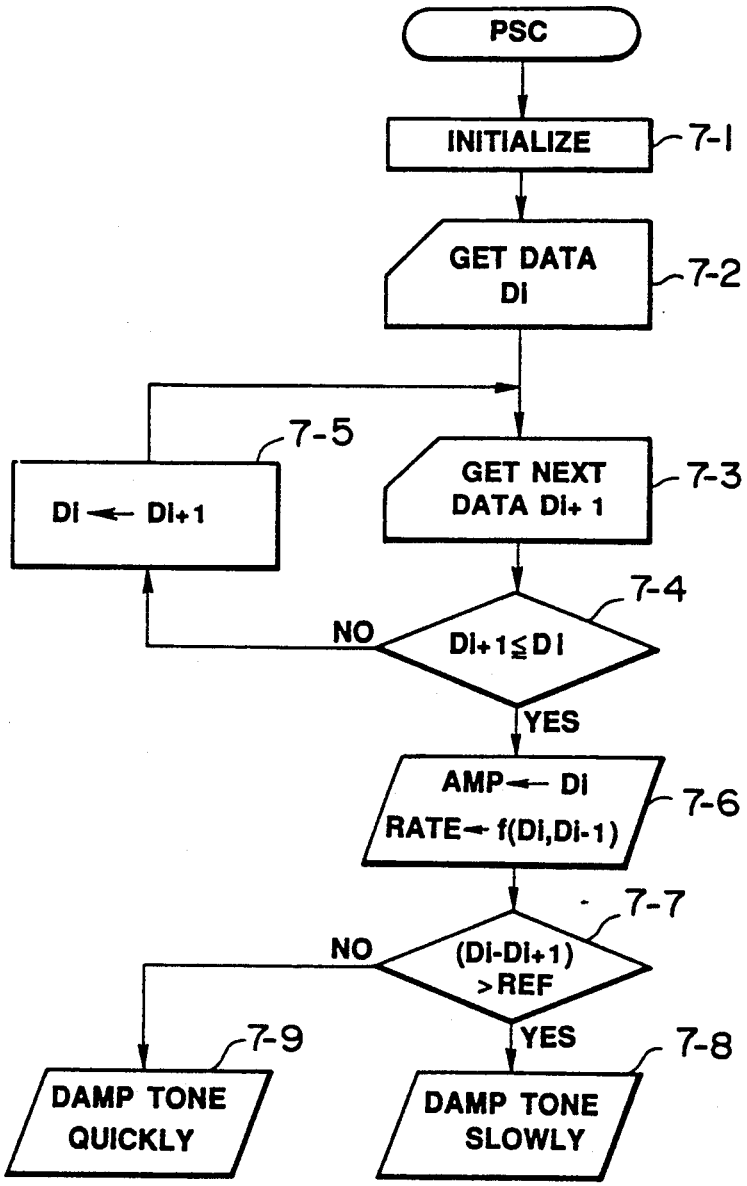
FIG. 7 is a flowchart of a tone control algorithm for the percussive sound.

FIG. 6(*a*) shows a time profile of the key displacement and FIG. 3(*b*) shows the corresponding tone envelope. FIG. 7 is a flow of the operation of the microprocessor in accordance with the percussive sound control algorithm.

Steps 7-1 to 7-6 in FIG. 7 are similar to steps 5-1 to 5-6 in FIG. 5. In these steps, the microprocessor 3 monitors when the key displacement will reach its first peak. If such peak has been detected, the microprocessor 3 derives envelope parameters of level and rate, AMP, RATE, from the digital sample of the peak displacement and the next, as indicated respectively by points 60 and 61 and sends them to the tone generator 6 to start the sounding of a tone.

Then, the microprocessor 3 calculates the difference between the digital sample of the peak displacement ($D_1$) and the next sample ($D_{i+1}$), and compares it with a reference value (step 7-7). If the difference ($D_i$-$D_{i+1}$) is greater than the reference, this means that the key is struck sharply and bouncing quickly. If the difference is lower than the reference, this indicates that the key is pressed down. Assume that the key is a stick and there is a vibration pad. Hitting the pad with the stick would cause the pad to vibrate. If the stick were immediately detached quickly from the pad, the vibration of the pad would continue and damp slowly. On the other hand, if the stick were pressed against the pad after hitting, this would stop or damp the vibration of the pad quickly.

This phenomenon is simulated by the microprocessor 3 using the percussive sound algorithm. More specifically, if the condition of step 7-7 i.e., ($D_i$-$D_{i+1}$)>reference value is satisfied, indicating a bouncing touch, the microprocessor 3 sends envelope parameters designating a slow damp to the tone generator 6 so that the tone will be reduced little by little (step 7-8). If the condition of step 7-7 is not met, indicating a press-down touch, the microprocessor 3 sends high release envelope parameters to the tone generator 6, causing the tone to make an abrupt damp (step 7-9). Since the key displacement profile in FIG. 6(*a*) illustrates a bouncing touch, the corresponding amplitude of the tone decreases slowly along an approximate exponential function, as seen by the curve 63 in FIG. 6(*b*).

Figure 8:
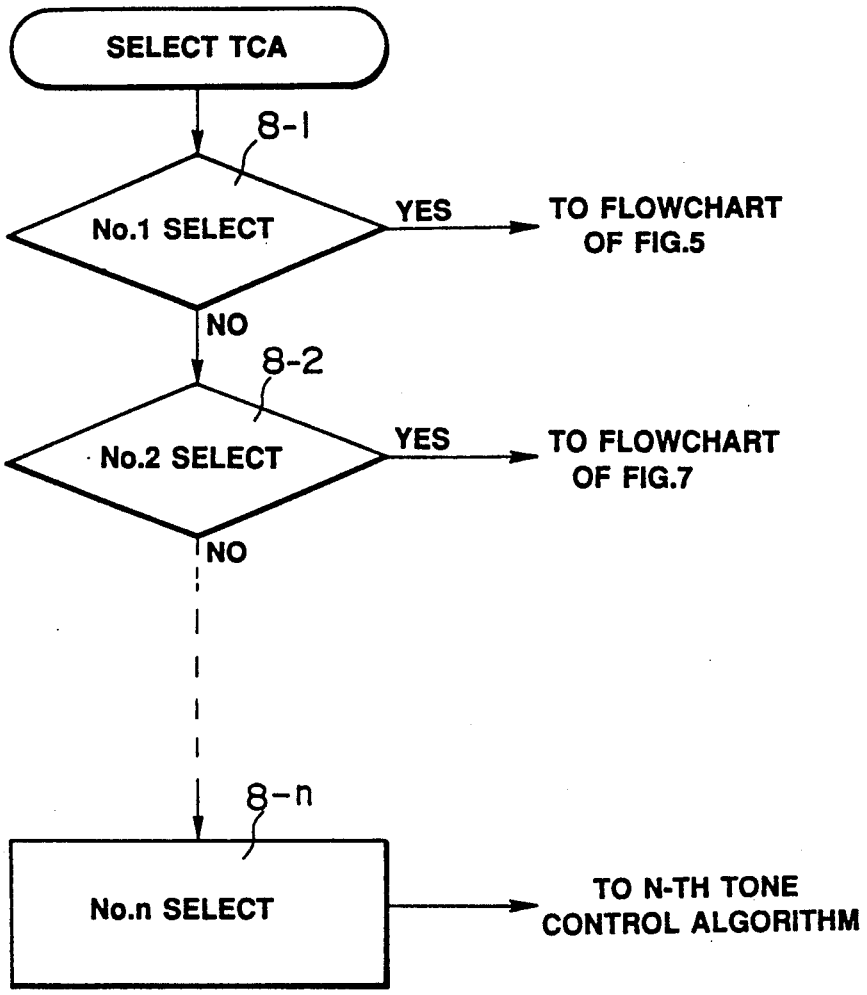
FIG. 8 is a flowchart of selecting one of the tone control algorithms.

FIG. 8 shows a flow of operation of the microprocessor for selecting one of the plurality of tone control algorithms from the memory 4 (e.g., the wind instrument sound control algorithm or percussive sound control algorithm) according to the selected information provided by the selector 5. When the information designates a first sound i.e., wind instrument sound (step 8-1), the microprocessor 3 processes the key displacement data in accordance with the wind instrument sound control algorithm shown in FIG. 5. If the select information designates a second or percussive sound (step 8-2), the key displacement data are processed based on the percussive sound control algorithm shown in FIG. 7. Similarly, if n-th sound has been selected (step 8-n) the corresponding sound control algorithm runs.

This concludes the description of the embodiment. However, various modifications and alternations are obvious to one skilled in the art without departing from the scope of the invention.

For example, the number of tone control algorithms provided for key displacement may be one or more than two.

Key displacement sensors could be implemented using a CDS sensing the amount of light variable with the movement of key, electric magnet, Hall device or piezoelectric device instead of variable resistor.

The internal tone generator 6 may be replaced by an external generator that is operatively connected to the keyboard instrument via any suitable communication interface such as Musical instrument Digital Interface (MIDI).

Therefore, the scope of the invention should be limited solely by the appended claims.

What is claimed is:

1. An electronic keyboard instrument, comprising:

a keyboard having a plurality of keys;

a plurality of key displacement sensor means each disposed in relation to a different one of said keys for detecting variable displacement of a key induced by key operation, and for providing a corresponding displacement signal; and tone control means for processing said displacement signal from each of said key displacement sensor means and for producing tone parameters on the basis of a processing operation on the displacement signal; and wherein said tone control means comprises:

initial peak detection means for detecting when the displacement signal has reached a first peak during a key operation, said first peak being defined by a first portion of said displacement signal that indicates greater key displacement than any other portion of said displacement signal preceding said first portion and also indicates greater key displacement than a second portion of said displacement signal next succeeding said first portion so that the magnitude of said first peak carries information about a feature of key touch dynamics, wherein said initial peak detection means includes means for measuring the magnitude of said first peak; and note-on means responsive to said initial peak detection means for producing a note-on signal indicative of the start of a tone, said note-on signal including a tone control parameter corresponding to said first peak.

2. The electronic keyboard instrument recited in claim 1 wherein said tone control means comprises vibrato control means for controlling vibrato parameters on the basis operation on the processing of the displacement signal.

3. The electronic keyboard instrument recited in claim 1 wherein each of said plurality of key displacement sensor means comprises:

a sensor for producing an analog signal indicative of key displacement, and analog-to-digital converter means for digitizing said analog signal at a predetermined sampling rate to provide digital samples of the key displacement.

4. The electronic keyboard instrument recited in claim 1 wherein said tone control means comprises means for producing a tone parameter as a function of a current magnitude of the displacement signal.

5. The electronic keyboard instrument recited in claim 1 wherein said tone control means comprises means for producing a tone parameter as a function of a difference between the magnitudes of the any two successive digital samples of the displacement signal.

6. The electronic keyboard instrument recited in claim 1 further comprising tone generator means disposed within the instrument for generating tones in response to the tone parameters produced by said tone control means.

7. The electronic keyboard instrument recited in claim 1, wherein said tone control parameter comprises an envelope parameter corresponding to said first peak and controlling the amplitude of a tone.

8. An electronic keyboard instrument, comprising:
a keyboard having a plurality of keys;
a plurality of key displacement sensor means each disposed in relation to a different one of said keys for detecting variable displacement of a key induced by key operation and for providing a corresponding displacement signal; and
tone control means for producing said displacement signal from each of said key displacement sensor means and for producing tone parameters on the basis of a processing operation on the displacement signal; and
wherein each of said plurality of key displacement sensor means comprises:
a sensor for producing an analog signal indicative of key displacement, and analog-to-digital converter means for digitizing said analog signal at a predetermined sampling rate to provide digital samples of said key displacement; and wherein said tone control means comprises:
note-on means for producing a note-on signal indicative of the start of a tone;
note-off means for producing a note-off signal indicative of the end of said tone;
direction determining means operative after the production of said note-on signal and before the production of said note-off signal for determining a direction of key movement from a comparison of any two successive digital samples of the key displacement from said analog-to-digital converter means; and
means responsive to said direction determining means for producing first tone parameters for controlling a first characteristic of said tone during its development when an associated key is moved downward and for producing second tone parameters for controlling a second characteristic of said tone during its development which is different from said first characteristic when the associated key is moved upward.

9. An electronic keyboard instrument, comprising:
a keyboard having a plurality of keys;
a plurality of key displacement sensor means each disposed in relation to a different one of said keys for detecting variable displacement of a key induced by a key operation, and for providing a corresponding displacement signal;
a plurality of selectively operative tone control means having tone control algorithms different from one another, for processing the displacement signal from said key displacement sensor means in manners different from one another to provide tone parameters; and
manually operative selector means for selecting one of said plurality of tone control means as being operative during play of the instrument, so that the selected tone control means commonly applies its tone control algorithm to displacement signals from said plurality of displacement sensor means.

10. The electronic keyboard instrument recited in claim 9, wherein said plurality of tone control means comprise a microprocessor and a memory for storing a plurality of tone control algorithms, and said microprocessor includes means for executing a tone control algorithm selected by said selector means.

11. An electronic keyboard instrument, comprising:
a keyboard having a plurality of keys;
a plurality of key displacement sensor means each disposed in relation to a different one of said keys for detecting variable displacement of a key induced by key operation, and for providing a corresponding displacement signal; and
tone control means for processing said displacement signal from each of said key displacement sensor means and for producing tone parameters on the basis of a processing operation on the displacement signal; and
wherein said tone control means comprises:
initial peak detection means for detecting when the displacement signal has reached a first peak during a key operation, said first peak being defined by a first portion of said displacement signal that indicates greater key displacement than any other portion of said displacement signal preceding said first portion and also indicates greater key displacement than a second portion of said displacement signal next succeeding said first portion so that the magnitude of said first peak carries information about a feature of key touch dynamics, wherein said initial peak detection means includes means for measuring the magnitude of said key peak; and
note-on means responsive to said initial peak detection means for producing a note-on signal indicative of the start of a tone; and
wherein said note-on means comprises means for producing a tone parameter as a function of said first peak from said initial peak detection means, so that a tone will be generated with an attack characteristic that is a function of said first peak.

12. An electronic keyboard instrument, comprising;
a keyboard having a plurality of keys;
a plurality of key displacement sensor means each disposed in relation to a different one of said keys for detecting variable displacement of a key induced by key operation, and for providing digital samples of key displacement at a predetermined sampling rate; and
tone control means for processing said digital samples of key displacement from each of said key displacement sensor means; and
wherein said tone control means comprises:
initial peak detection means for detecting when the digital samples have reached a first peak during a key operation;
attack control means responsive to said initial peak detection means for controlling an attack characteristic of a tone in accordance with said first peak, said first peak being defined by a first portion of said displacement signal that indicates greater key displacement than any other portion of said displacement signal preceding said first portion and also indicates greater key displacement than a second portion of said displacement signal next succeeding said first portion so that the magnitude of said first peak carries information about a feature of key touch dynamics, wherein said initial peak detection means includes means for measuring the magnitude of said first peak;
comparing means for comparing a digital sample at said first peak and a next digital sample, and for providing a corresponding comparison signal; and
damp control means responsive to said comparing means for controlling a release characteristic of said tone in accordance with said comparison signal.

* * * * *